United States Patent [19]

Bodine

[11] 4,280,557

[45] Jul. 28, 1981

[54] SONIC APPARATUS FOR CLEANING WELLS, PIPE STRUCTURES AND THE LIKE

[76] Inventor: Albert G. Bodine, 7877 Woodley Ave., Van Nuys, Calif. 91406

[21] Appl. No.: 93,505

[22] Filed: Nov. 13, 1979

[51] Int. Cl.[3] ..... E21B 37/00; E21B 43/25

[52] U.S. Cl. ..... 166/177; 166/249; 166/311

[58] Field of Search ..... 15/104.05; 166/177, 166/249, 311; 134/1; 175/56, 67; 299/14

[56] References Cited

U.S. PATENT DOCUMENTS

| | | | |
|---|---|---|---|
| 2,680,485 | 6/1954 | Bodine | 166/177 X |
| 2,730,176 | 1/1956 | Herbold | 166/177 |
| 3,016,093 | 1/1962 | Bodine | 166/249 |
| 3,322,196 | 5/1967 | Bodine | 166/249 |
| 3,335,801 | 8/1967 | Wilsey | 166/177 |
| 3,409,031 | 11/1968 | Benbow et al. | 15/104.05 X |
| 3,633,688 | 1/1972 | Bodine | 175/56 X |
| 3,648,769 | 3/1972 | Sawyer | 166/177 |

*Primary Examiner*—James A. Leppink
*Assistant Examiner*—George A. Suchfield
*Attorney, Agent, or Firm*—Edward A. Sokolski

[57] ABSTRACT

An oscillator for generating sonic energy in a rotary progression vibration mode about a longitudinal axis, i.e., having quadrature related lateral vibration components, is lowered into a tube or pipe member, which may comprise an oil well casing. Attached to the housing of the oscillator so as to receive vibratory energy therefrom is a hollow stem member which is suspended from the oscillator housing within the pipe member at a position therealong proximate to apertures in the wall thereof to be cleaned. The stem member is vibrated at a sonic frequency by the sonic energy generated by the oscillator in a gyratory vibration mode having lateral quadrature related vibration components. The stem member and oscillator are spaced from the wall of the tube member, there being liquid in this space, with the stem member acting as a transmitter of sonic energy in the liquid. The vibratory energy causes successive pressure and vacuum regions to form in the liquid with a cyclical rotating force pattern which rotates around the inside of the tube or casing member in the nature of a rotating scraper. The rotary sonic vibration of the liquid dislodges and sweeps the dirt away from regions in and around the apertures of the casing member, which dirt may be taken into the interior of the stem member.

8 Claims, 7 Drawing Figures

SONIC APPARATUS FOR CLEANING WELLS, PIPE STRUCTURES AND THE LIKE

This invention relates to the cleaning of tubular members, such as heat exchangers, boilder tubes, oil well casings, and the like, and more particularly to a method and apparatus employing sonic energy for removing foreign matter from or through the tube wall or apertures employed to draw fluid into casings.

The cleaning of casing members, such as oil well casings and the formation therearound, particularly at substantial depths below the surface, presents a never-ending problem. Oil wells frequently employ a lower region of casing or liner that is apertured with slots or perforations or wire wrapped screen construction which permit the entry of the desired fluids but tend to exclude sand and other foreign matter, operating in the nature of a screen or filter. Such apertures often become clogged with tar, parafin, clay, precipitates, salt and other foreign matter, and sometimes corrode shut. This, of course, severely hampers the flow of oil or other fluid into the casing, greatly decreasing the efficiency of the pumping operation.

The apparatus and method of the present invention provides highly efficient means for clearing apertures in casing members, such as oil well casings and the formation therearound, at substantial depths below the surface. This end result is achieved in situ at a relatively low expense without significantly disrupting normal operation of the system with which the casing is involved for any great length of time.

These results are achieved with the method and apparatus of the present invention by lowering a sonic oscillator member which may comprise an orbiting mass oscillator having a gyratory or rotary vector vibration mode into the casing. Suspended from the oscillator, typically through the region of the blockage of the casing, and fixedly attached to the housing thereof is a hollow stem member to which the rotary vector vibrational energy from the oscillator is transferred. The oscillator and stem member are separated from the tubular casing or the like, there being fluid in this spacing. Typically, the stem or transmitter member may be at least one-half of the diameter of the casing. The stem member is caused to vibrate in a rotary progression vibration mode which may be resolved into quadrature related lateral vibration vector components, this energy being transferred to the surrounding fluid, particularly to the fluid trapped in the annulus formed in the casing. The vibrational energy in the fluid manifests itself in a whirling vibration with pressure and vacuum regions of the fluid rotating or progression around the annulus inside of the casing much as a rotating scraper which dislodges and sweeps the foreign matter from the apertures in a powerful and high-speed manner. Check valve means actuated in a pumping manner by the vibration may be provided in the hollow stem member for causing the entry of the dislodged foreign matter into the hollow stem from where smaller particles of this matter or screened liquid are discharged through ports located at a suitable position therealong and fed back into the casing.

This rotary wave vibration may also be transmitted via the liquid body in the well to a conventional gravel packing outside of the casing perforations whereby the gravel pack may be cleaned, or, in some wells, very advantageously recompacted to aid in the implementation of gravel screening.

It is therefore an object of this invention to facilitate the cleaning of fluid passages and surrounding formations of oil well casings at substantial distances from the surface of the ground.

It is a further object of this invention to provide an improved method and apparatus for employing sonic energy to dislodge foreign particles from apertured portions of oil well casings and the like.

It is a further object of this invention to fluidize a gravel pack around a well casing for cleaning thereof and particularly to increase the final gravel packing density or settlement.

Other objects of this invention will become apparent as the description proceeds in connection with the accompanying drawings of which:

FIGS. 1A–1D are side elevational views partly in cross section of a first embodiment of the invention;

Figure 2:
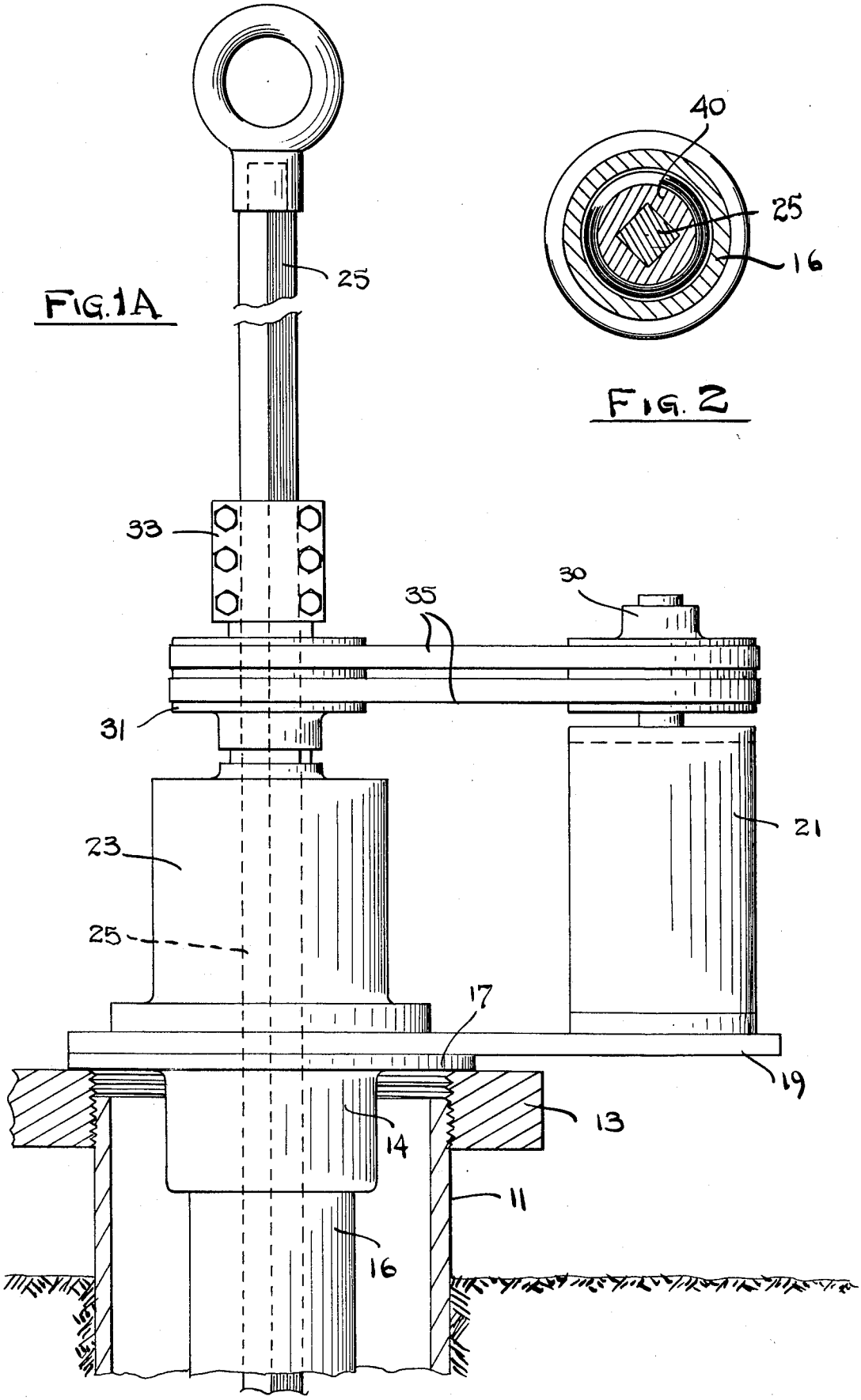
FIG. 2 is a cross-sectional view taken along the plane indicated by 2–2 in FIG. 1B.
Figure 1B:
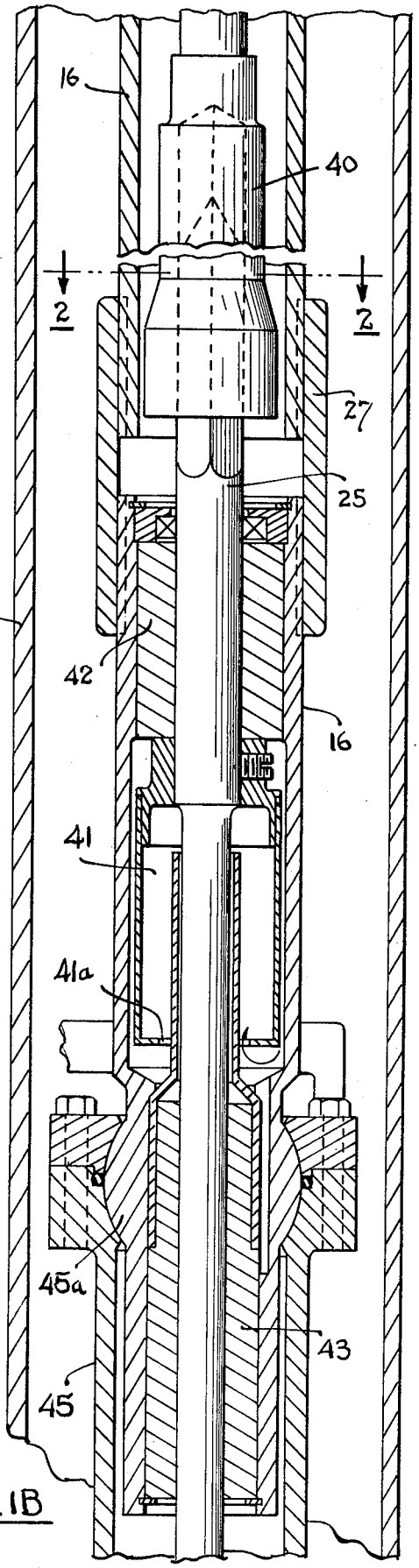
Figure 1C:
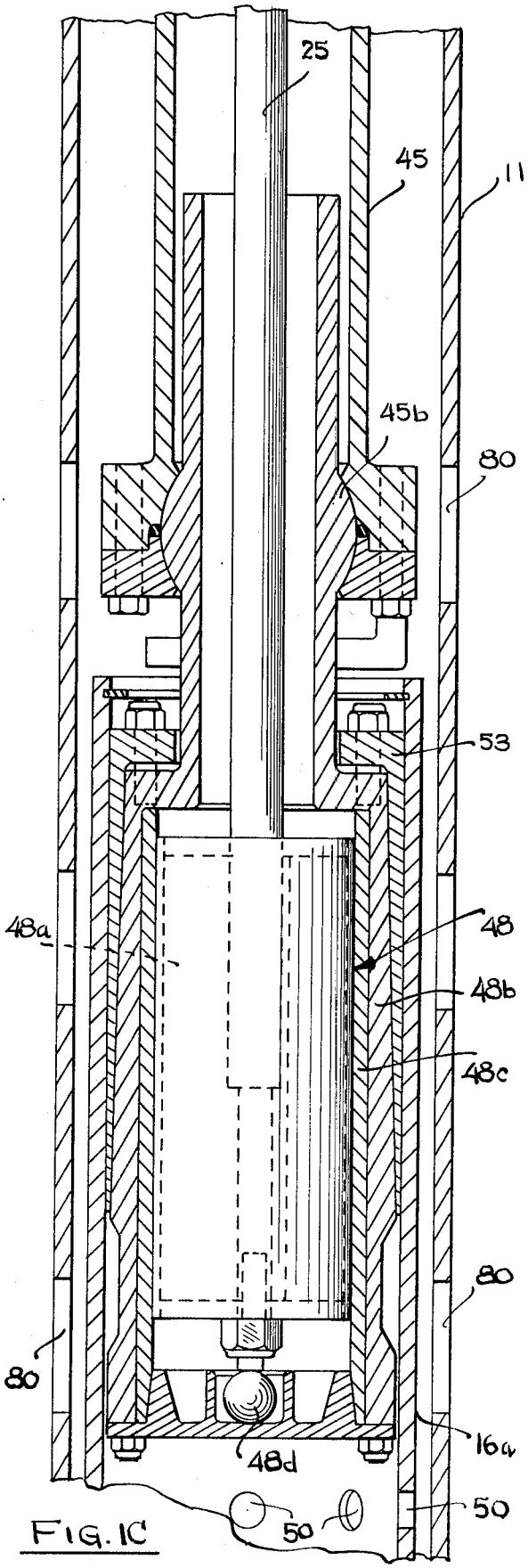
Figure 3:
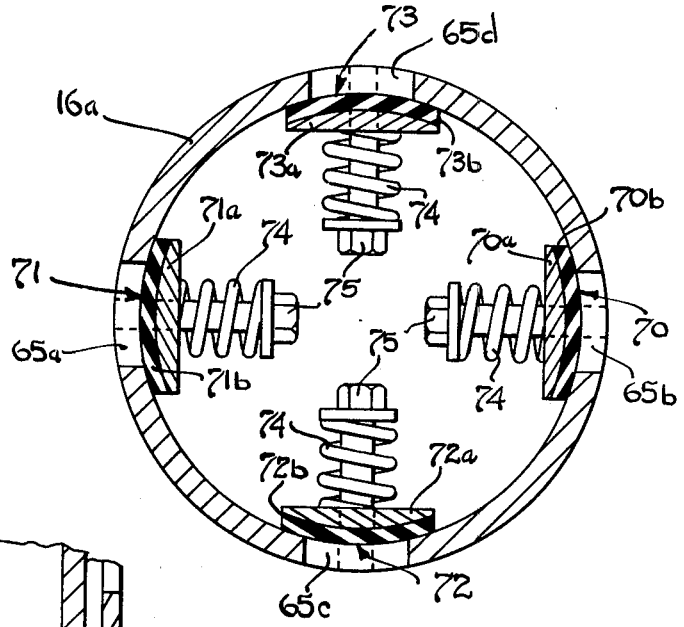
FIG. 3 is a cross-sectional view taken along the plane indicated by 3—3 in FIG. 1D.
Figure 1D:
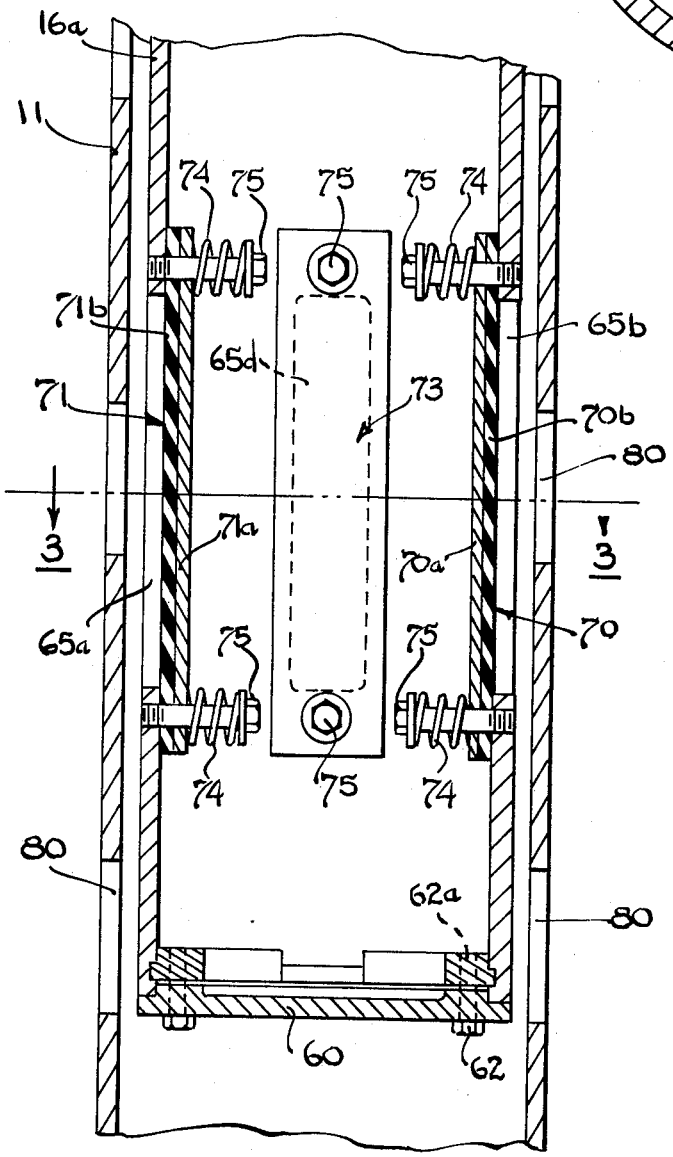

Referring now to FIGS. 1A–1D, 2 and 3, a first embodiment of the invention is illustrated. Threadably attached to the top end of oil well casing 11 is an annular mounting flange 13. Attached to mounting flange 13 by means of threaded coupling and plate member 14 is elongated hollow tubing stem member 16. Stem member 16 is integrally connected with plate 14 which in turn is integral with plates 17 and 19. Fixedly supported on plate 19 are motor 21, which may be hydraulic, and sleeve bearing assembly 23. Rotatably supported in sleeve bearing assembly 23 is elongated top rod member 25 which may comprise a sucker rod normally available at oil well installations and which has a squared region as shown. Rod member 25 is connected by standard screwed couplings to further standard sucker rods (not shown) suspended within hollow tubing stem member 16. Rod member 25 is rotatably driven by the pulley-drive belt assembly including pulley wheel 30 attached to the drive shaft of motor 21, pulley wheel 31, which is clamped to the rod by means of clamp member 33, and drive belts 35 which interconnect the two wheels. This in turn rotationally drives the whole rod string as a drive shaft.

In view of the great length of the drive shaft in most situations, the shaft is preferably made in a plurality of standard sucker rod sections which are joined together at regular intervals by standard screwed joints not shown. The tubing string 16 is connected by collars 27 as shown. The section of the bottommost rod located at the splined joint above the oscillator 48 is coupled by a sleeve coupler 40 which threadably engages this lowermost shaft section. A coupling assembly 45, which joins sections of the assembly together by means of ball joints **45*a* and 45*b*, is employed to provide flexibility between the oscillator vibrations and the relatively stationary lower portions of the tubing stem 16** attached thereto.

A centrifugal sand barrier 41 of the type described in my U.S. Pat. No. 4,091,988 is provided to prevent solid particles such as sand from reaching the bearing and ball joints, this foreign matter being centrifugally trapped within the rotating cavity at 41 and cleaned from the lubricating water or other fluid which is fed through port **41*a* and about drive shaft 25, in the manner described in U.S. Pat. No. 4,091,988. Sleeve bearings 42 and 43 are provided to support drive shaft 25**.

Coupled to stem 16 through coupling assembly 45 is oscillator 48 which is of the orbiting mass type having an unbalanced rotor 48*a* so that when this rotor is driven, rotary or gyratory vibrational energy is developed in the housing 48*b* of the oscillator. This type of oscillator rotor is described in my U.S. Pat. Nos. 3,633,688 and 4,096,762. Oscillator 48 has an unbalanced rotor, such unbalancing being achieved either by aperturing the rotor as described in my U.S. Pat. No. 3,633,688, or employing lighter and heavier rotor portions, as described in my U.S. Pat. No. 4,096,762. Rotor 48*a* is rotatably supported in housing 48*b* in which it is rotatably driven on sleeve bearing 48*c* (typically fabric-phenolic) by means of shaft 25, bearing ball 48*d* providing vertical thrust load bearing support. The housing 48*b* of the oscillator is clamped to lower transmitter stem portion 16*a* by means of wedge collet clamp 53 which wedges between the inside wall of stem portion 16*a* and the outer slanted wall portion of housing 48*b*. Stem member 16*a* is hollow and has a plurality of discharge ports 50 formed in the top portion thereof for discharging smaller particles of foreign matter or liquid removed from the casing from slots 80 and from the formation therearound.

The lower end of transmitter stem member 16*a* is closed off by a removable lid member 60 which is held to the bottom portion by means of bolts 62 and segments 62*a* and can be removed to clean out foreign matter trapped in the stem. Four check valved inlet ports 65*a*–65*d* are provided to permit the inflow into the stem of foreign matter removed from the casing region. Each of these ports is normally sealed by a flapper check valve 70–73. These flapper valves each include a metal backing plate 70*a*–73*a* with a rubber facing portion 70*b*–73*b* fixedly attached thereto. The backing plates and rubber facings are resiliently urged against the surrounding walls of ports 65*a*–65*d* by means of coil springs 74 which are retained against the backing plates by means of bolts 75 which threadably engage the walls of stem portion 16*a*.

The system of the invention operates as follows. When the rotor of oscillator 48 is rotatably driven, typically at a speed of 20 to 100 cycles per second, rotational lateral vibration is set up in the housing of the oscillator, which vibrational energy is transferred to transmitter member as a rotary wave vibration of stem 16*a*. This progression rotary vibration can be resolved into lateral quadrature related force vector components. The vibrational energy as already described earlier in the specification effects a whirling vibratory pressure action in the fluid container in the annulus between the inner wall of casing 11 and the outer wall of member 16*a*. The pressure amplitude is made quite high by the containment provided by the casing annulus. This rotary sonic vibration of the fluid dislodges and sweeps foreign matter which may be lodged in casing slots 80. The pressure swings are 180° opposed on opposite sides of member 16*a*. The vibratory pressure energy also operates to effect opening and closing of valves 70–73, the foreign matter being swept through these valves into the interior of the stem. The larger particles are retained within the stem for subsequent removal when the stem is withdrawn from the casing, while smaller particles or simply liquid which may include portions of the foreign material pulverized by the sonic action are passed through discharge ports 50 back into the casing.

Figure 4:
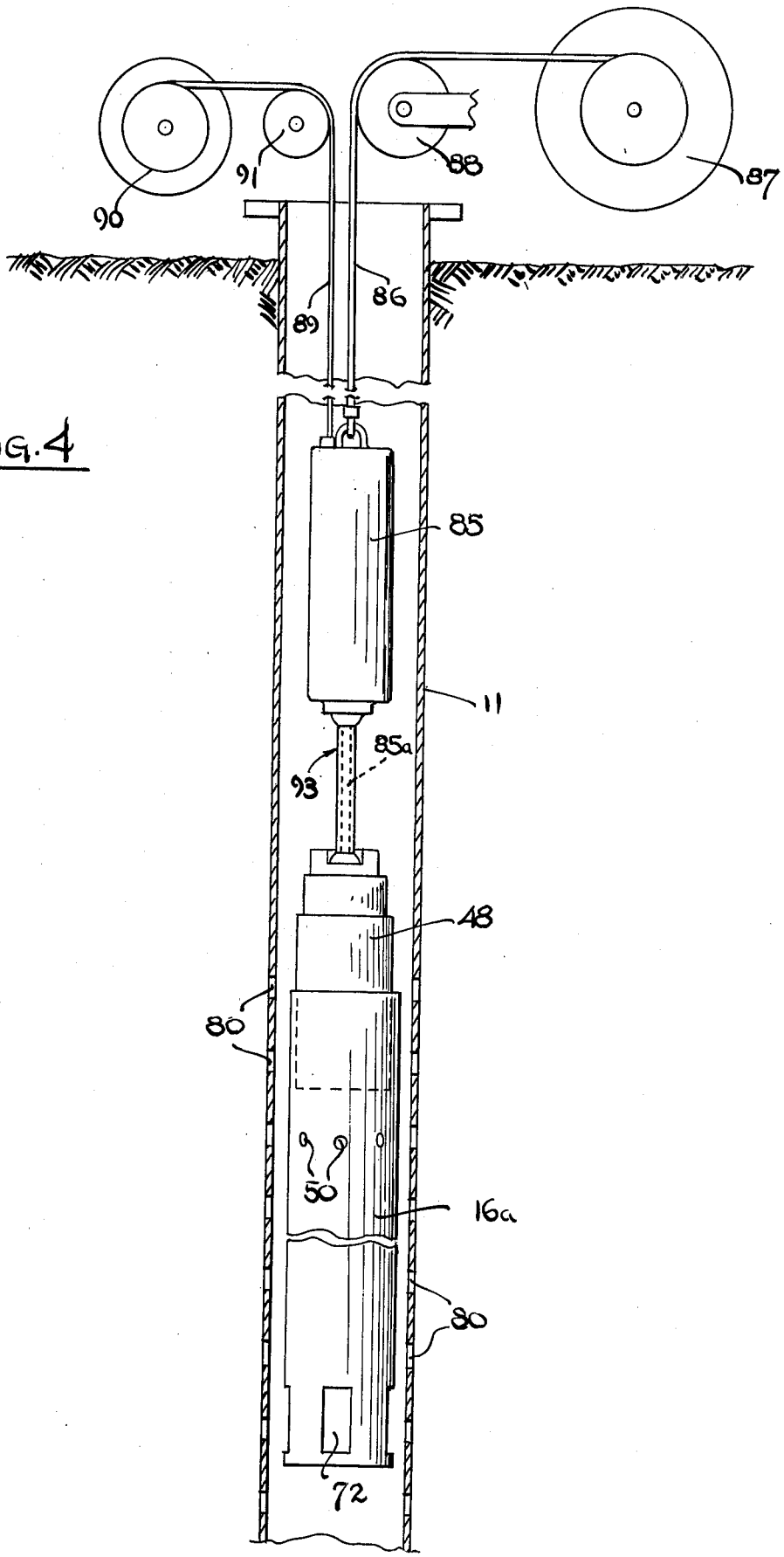
FIG. 4 is a cross-sectional view in elevation of a second embodiment of the invention.

Referring now to FIG. 4, a second embodiment of the invention is illustrated. In this second embodiment, rather than employing a long tubing stem member and internal drive rod, such as sucker rod sections, an electric motor is used for driving the oscillator, this motor being suspended along with the oscillator and the lower transmitter member on a cable. Electric motor 85 is suspended within oil well casing 11 on tension cable 86 which is unwound from drum 87 over pulley wheel 88. An electric cable 89 for supplying power to the motor is unwound from drum 90 around pulley wheel 91. The drive shaft 85*a* of the motor is coupled to orbiting mass oscillator 48 through ball joint coupling assembly 93 similar to the previous embodiment. Oscillator 48 is the same type oscillator as described in connection with the previous embodiment and, as for the previous embodiment, has its housing clamped to transmitter member 16*a* which is similar in structure to the transmitter member 16*a* of the first member. Operation is just as described for the first embodiment with the sonic energy dislodging foreign particles in the region of the slots 80 of the casing, such foreign material being passed through valves 70–73 into the interior of the stem 16*a* from where smaller particles are discharged through ports 50.

The embodiment of FIG. 4, like the previously described embodiments, may employ a large diameter sonic transmitter member 16*a* so as to provide a narrow annular passage therearound the inside of casing 11. This annulus provides a fairly high acoustic impedance in the entrapped liquid therein so that the rotary wave motion of stem 16*a* can generate high sonic pressure swings, both positive and negative in opposed phase across the diameter of stem 16*a*. This rotating pulse vibration system is powerful in accomplishing the objectives hereof.

While the invention has been described and illustrated in detail, it is clearly to be understood that this is by way of illustration and example only and is not to be taken by way of limitation, the spirit and scope of the invention being limited only by the terms of the following claims.

I claim:

1. Apparatus for cleaning an extended number of apertured portions of the lower regions of an oil well casing sunk in the ground, said casing having a liquid therein comprising a sonic oscillator, a stem member in the form of an elongated elastic tube which runs along said extended number of apertured portions, said oscillator being attatched to the top end of said stem member in the region of the apertured portions to be cleaned, said stem member being located within said casing closely spaced to the inner walls thereof for limited freedom of motion generally normal to the longitudinal axis of said casing, and means for driving said oscillator in a rotary vibrational mode having quadrature related vibrational force vectors generally normal to the longitudinal axis of said casing and said stem member, said vibrational force components being transferred to said stem member, a portion of the liquid being in the space between said stem member and casing, the vibrational energy in the stem member causing successive pressure and vacuum regions for form in the liquid with a cyclical force pattern which rotates around the inside wall of the casing and dislodges foreign matter from the apertured portions and sweeps away said foreign matter.

2. Apparatus for cleaning portions of a tube structure having a liquid therein comprising a sonic oscillator, a stem member drivingly connected to said oscillator in the region of the tube structure portions to be cleaned, said stem member being located within said tube structure spaced from the inner walls thereof for limited freedom of motion generally normal to the longitudinal axis of said tube structure, and means for driving said oscillator in a rotary vibrational mode having quadrature related vibrational force vectors generally normal to the longitudinal axis of said tube structure and said stem member, said driving means comprising a motor located above the tube structure and a rod member rotatably driven by the motor and extending down through the tube structure to the oscillator, and means for coupling the rod member to the rotor of said oscillator, said vibrational force components being transferred to said stem member, a portion of the liquid being in the space between said stem member and tube structure, the vibrational energy in the stem member causing successive pressure and vacuum regions to form in the liquid with a cyclical force pattern which rotates around the inside wall of the tube structure and dislodges foreign matter from the tube structure and sweeps away said foreign matter.

3. The apparatus of claim 2 wherein the means for driving the oscillator comprises a rod member and a motor coupled to one end of said rod member, said rod member running through the stem member to said oscillator and coupled thereto at the other end thereof.

4. The apparatus of claim 3 wherein the rod member is formed in sections and splined joint means for removably joining the rod member to said oscillator.

5. Apparatus for cleaning portions of a tube structure having a liquid therein comprising a sonic oscillator, a hollow stem member drivingly connected to said oscillator in the region of the tube structure portions to be cleaned, said stem member being located within said tube structure spaced from the inner walls thereof for limited freedom of motion generally normal to the longitudinal axis of said tube structure, there being ports formed in the walls of said stem member, means for driving said oscillator in a rotary vibrational mode having quadrature related vibrational force vectors generally normal to the longitudinal axis of said tube structure and said stem member, said vibrational force components being transferred to said stem member, a portion of the liquid being in the space between said stem member and tube structure, the vibrational energy in the stem member causing successive pressure and vacuum regions to form in the liquid with a cyclical force pattern which rotates around the inside wall of the tube structure and dislodges foreign matter from the tube structure and sweeps away said foreign matter, and flapper valve means for covering said stem member ports, said valve means periodically opening and closing in response to the vibratory force to permit foreign matter dislodged from the tube structure to pass to the inside of the stem member.

6. The apparatus of claim 5 and additionally including discharge ports formed in the walls of said stem member above the valves, smaller particles of the foreign matter being discharged through said discharge ports back into the tube structure.

7. Apparatus for cleaning portions of a tube structure having a liquid therein comprising a sonic oscillator, means for suspending the oscillator within the tube structure comprising a cable attached to the oscillator and means for unwinding and winding the cable from a position outside of said tube structure, a hollow stem member drivingly connected to said oscillator in the region of the tube structure portions to be cleaned, said stem member being located within said tube structure spaced from the inner walls thereof for limited freedom of motion generally normal to the longitudinal axis of said tube structure, there being ports formed in the walls of said stem member, means for driving said oscillator in a rotary vibrational mode having quadrature related vibrational force vectors generally normal to the longitudinal axis of said tube structure and said stem member, said vibrational force components being transferred to said stem member, a portion of the liquid being in the space between said stem member and tube structure, the vibrational energy in the stem member causing successive pressure and vacuum regions to form in the liquid with a cyclical force pattern which rotates around the inside wall of the tube structure and dislodges foreign matter from the tube structure and sweeps away said foreign matter, and flapper valve means for covering said stem member ports, said valve means periodically opening and closing in response to the vibratory force to permit foreign matter dislodged from the tube structure to pass to the inside of the stem member.

8. The apparatus of claim 7 and additionally including discharge ports formed in the walls of said stem member above the valves, smaller particles of the foreign matter being discharged through said discharge ports back into the tube structure.

* * * * *